United States Patent [19]

Miksic et al.

[11] 4,275,835

[45] Jun. 30, 1981

[54] CORROSION INHIBITING ARTICLES

[76] Inventors: Boris A. Miksic, 21 Black Oak Rd., North Oaks, Minn. 55110; Robert H. Miller, 535 S. Lexington Ave., St. Paul, Minn. 55116

[21] Appl. No.: 130,848

[22] Filed: Mar. 17, 1980

Related U.S. Application Data

[63] Continuation-in-part of Ser. No. 36,317, May 7, 1979, abandoned, which is a continuation-in-part of Ser. No. 924,977, Jul. 17, 1978, abandoned.

[51] Int. Cl.[3] ..... C23F 11/02; B32B 3/26; B32B 5/18

[52] U.S. Cl. ..... 239/60; 252/390; 252/392; 422/9; 428/40; 428/311; 428/343; 206/205

[58] Field of Search ..... 422/9, 10, 16; 252/389 R, 390, 392; 239/56, 60; 428/40, 311, 343; 206/205

[56] References Cited

U.S. PATENT DOCUMENTS

| | | | |
|---|---|---|---|
| 2,512,949 | 6/1950 | Lieber | 422/9 X |
| 2,752,221 | 6/1956 | Wachter et al. | 428/537 |
| 2,943,909 | 7/1960 | Wachter et al. | 422/9 |
| 3,642,998 | 2/1972 | Jennings | 206/207 |
| 3,803,049 | 4/1974 | Korpics | 252/390 |
| 3,836,077 | 9/1974 | Skildum | 422/9 X |

*Primary Examiner*—Barry Richman
*Attorney, Agent, or Firm*—Jacobson and Johnson

[57] ABSTRACT

A corrosion inhibiting device including an extremely stable, man-made synthetic carrier having chemical and physical stabilities compatible with hostile and adverse environments for dispensing corrosion inhibiting chemicals, in virtually any ratio desired and/or required by the material to be protected from the corrosive environments, wherein the carrier has a multiplicity of sites, which are uniquely adaptable for solvent conveyance, carrier reception and carrier retention via solids entrapments, of amorphous and/or crystalline materials in multi-nucleated centers, and wherein the corrosion inhibitors located therein contain corrosion inhibitors which are classified and selected according to their vapor pressures.

2 Claims, 5 Drawing Figures

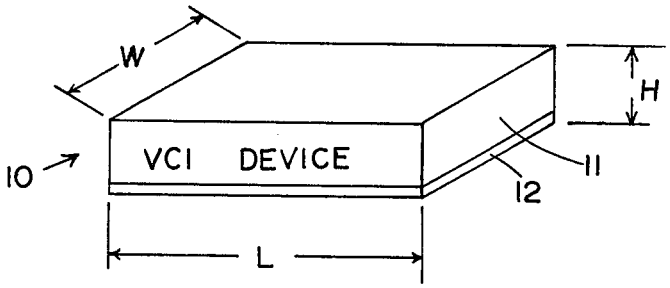
FIG. 1
FIG. 2
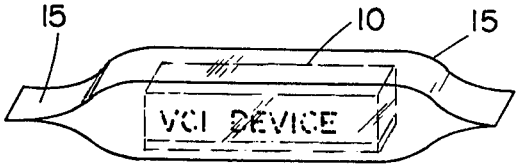
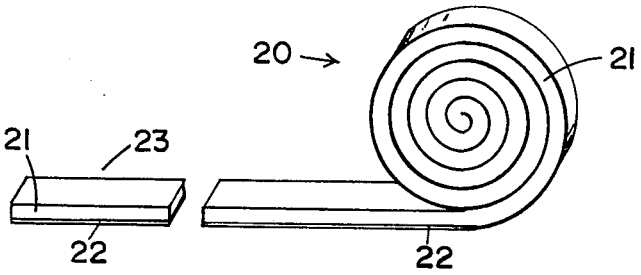
FIG. 3
FIG. 4
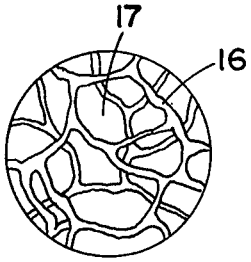

CORROSION INHIBITING ARTICLES

CROSS REFERENCE TO RELATED APPLICATIONS

This application is a continuation-in-part of the application U.S. Ser. No. 36,317 titled CORROSION INHIBITING ARTICLES, filed May 7, 1979, which is a continuation-in-part of the application U.S. Ser. No. 924,977 titled APPARATUS FOR DISPENSING CORROSION INHIBITING MATERIAL, filed July 17, 1978, both abandoned.

BACKGROUND OF THE INVENTION

1. Field of the Invention

This invention relates generally to reticulated foam carriers in combination with two or more corrosion inhibitors impregnated therein that synergistically coact to provide quicker and longer corrosion protection in environments hostile to even the carrier. More specifically, to a high density carrier for holding either separate or in combination one, two, three or more volatile corrosion inhibitors of different vapor pressures. The carrier's rugged, relatively inert, highly flexible, open reticulated nature, and appropriately high chemical resistance, permits and enables the carrier, with vapor phase inhibitor systems, to be placed in remote, corrosive and environmentally hostile locations.

The present invention comprised an improvement to the corrosion inhibiting art: (a) through the use of foams such as isocyanate-derived polymer foams, or reticulated isocyanate-derived polymer foams, that possess both high chemical and physical resistance to hostile environments and also possess a large available volume capable of holding (b) one, two, three or more corrosion inhibitors of different vapor pressures.

The concept of foams and reticulated foams are known in the art. Reticulated foams are described in U.S. Pat. No. 3,025,200. The reticulated foams are noted for their improved compression/deflection characteristics including increased tear and tensile strength, elongation and surface-volume ratios. One feature of the present invention is the discovery that one can use isocyanate-derived polymer foams or partially reticulated isocyanate-derived polymer foams to provide, (a) a surprisingly high environmentally wet or dry stability and resistance that is far greater than foam rubber or the known cellulosic materials and (b) a more efficient and more effective carrier for volatile corrosion inhibitors than the known foam rubber or cellulosic materials such as Kraft Paper, cloth, paper-board or felt.

It was further discovered in this invention, that the protection provided by this foam and the greater working surface area provided to the corrosion inhibitor by impregnation, retention, distribution and deposition in the boundless multiple of cavities of the reticulated foam resulted in a more rapidly attained and longer sustained effective levels in the vapor pressure curve and the area under the curve was greatly enhanced. Furthermore, the area between the curve and the critical effective level line (both lines were virtually parallel) was elongated and essentially rectangular. This is in sharp contrast to the normally experienced slow but continued reduction of the corrosion inhibitor's efficiency levels and their continually dwindling partial pressures with time and concurrent with the progressive contraction of the total surface area during the volatilization era. This invention overcomes the smaller surface area, and the consequentially small particle population of a given quantity, of the usual and typical, random, mechanically mixed, granular corrosion inhibitors commonly employed in practice. The above deficiencies have previously restricted the efficiency and effectiveness of volatile corrosion inhibitors. The restrictions imposed by a comparatively small surface area and a small particle pollution are even further hampered as the surfaces of the corrosion inhibiting granules themselves become progressively inefficient with time and by secondary contamination. A hostile and unfavorable environment usually aggravates the situation and results in a further loss of efficiency and hence effectiveness.

These serious deficiencies are essentially negated by the use of the invention's unique combination of the transport carrier and the transported impregnated component (s). This unique combination maintains the surfaces of the impregnated volatile corrosion inhibitor cleaner and each cavity is under a slight positive pressure and, hence, more readily efficient and effective when placed in hostile environments. The comparatively large capacity of the carrier system and the larger surface area of the volatile corrosion inhibitor distributed throughout the multiple cavities of the reticulated foam effectively blocks and/or markedly restricts contamination from air-borne particles, e.g. (a) solid phase particles such as dirt, dust, etc. (b) liquid phase particles, such as aerosols, related suspended materials, etc., (c) other materials inherent to and/or associated with the above solid or liquid phases, and (d) reasonable quantities of substances splashed, thrown, etc. into the region occupied by or onto the corrosion inhibiting device.

The serious deficiencies mentioned earlier are further negated by the deaeration and the solvent impregnation of the multiple cavities of this unique carrier when followed by the selective evaporation of the solvents. The carrier creates an enormous expansion of the semi-trapped or semi-containerized active component (s), which favors their positive partial pressure(s).

In the case of impregnation of one, two, three or more volatile corrosion inhibitors, the cavity walls are covered and the cavities themselves are partially filled with porous structure exhibiting a very large surface area analogous to that of a natural sponge. Recovered materials show depressed melting points.

2. Description of the Prior Art

The concept of corrosion inhibition in which a monomolecular layer is deposited on the surface to be protected is well known. Volatile corrosion inhibitors are described in an article by Boris A. Miksic titled "Volatile Corrosion Inhibitors Find A New Home", and published in Chemical Engineering, Sept. 26, 1977. The concept of using a dimensional mass of an ester sponge having a single excavated cavity therein for holding mechanically placed granular random mixed corrosion inhibitors is shown in the Skildum U.S. Pat. No. 3,836,077. Briefly, the Skildum patent shows a device for protecting structures from corrosion, or the like, during storage, where the carrier has at least one such mechanically excavated opening therein. The opening contains a simple mechanically blended, solid, granular mixture of organic ammonium nitrites, fungistats, and anti-oxidants to provide corrosion protection. A further type of corrosion inhibiting invention is shown in the Wachter, et al., U.S. Pat. No. 2,643,176 in which various comparatively solid absorbent materials, derived from natural products, such as, cellulosic substances and their derivatives, including papers, cardboard, fiber-board, wood, cotton cloth and the like are coated, impregnated or otherwise contain one or more of the vapor phase inhibitors The Miksic U.S. Pat. No. 4,051,066 teaches incorporation of a corrosion inhibitor into an elastomer rubber mixture and suggests that it is known that the prior art uses hollowed-out reservoirs (for holding vapor phase inhibitors) and uses recepticles comprised of a porous or open cell material such as foam rubber, Kraft paper, cloth, paperboard, felt or sponge. The Miksic U.S. Pat. No. 4,051,066 further theorizes that all of the prior art material can be impregnated or coated with the inhibitor material. While theorized as possible, the impregnation of ordinary foam rubber materials was not believed to be sufficiently stable, since foam rubber degrades in a corrosive environment; however, it has been discovered that an isocyanate-derived polymer foam provides an excellent, physically and chemically stable carrier, for either single or multiple inclusions of vapor phase inhibitors intended for placement in corrosive and environmentally hostile location, even in inaccessible remote sites, where long life and high stability are essential.

The Jennings U.S. Pat. No. 3,642,998 shows a corrosion inhibiting tool box which is designed to close as tightly as possible. Located in the bottom of the Jennings tool box is an open celled foam material which forms a carrier for a volatile corrosion inhibitor. The volatile corrosion inhibitor comprises granules of volatile amine nitrite which are emitted from the carrier upon placement of a tool on the carrier. Jennings suggests the use of dicyclohexyammonium nitrite and diisopropylammonium nitrite and mixtures thereof with the volatility in the range of $10^{-3}$ to $5\times10^{-2}$ millimeters of mercury at 68° F. Jennings requires that the box be as tightly closed as possible and that the placement of tools in the tool box causes flexure of the foam to expel vapor therefrom.

The Korpics U.S. Pat. No. 3,803,049 teaches that the mixtures of benzotriazole and tolyitriazole act as a vapor phase corrosion inhibitor for copper and copper alloys without the use of a solvent system.

The Lieber U.S. Pat. No. 2,512,949 teaches the treatment of a fiberous material such as paper textures, etc. with a volatile compound. The fiberous material emits a vapor which deposits a corrosion inhibition film on metal objects. Lieber utilizes amines and amino alcohols as the volatile compound.

The Wachter, et al., U.S. Pat. No. 2,943,908 teaches compositions of vapor phase inhibitors which contain fungicidal properties to inhibit fungus growth during storage of metals. Specifically, Wachter teaches that compounds of dicyclohexylammonium nitrite, dicyclohexylammonium nitrophenate, diisopropylammonium nitrite, cyclohexylammonium nitrophenate can be used.

The Wachter, et al., U.S. Pat. No. 2,752,221 teaches improved vapor phase corrosion inhibitors which are made of a basic acting agent and an organic nitrogen base salt of nitrous acid. The suggested nitrogenous bases are primary amines such as isopropylamine, cyclohexylamine, benzylamine, allylamine, secondary amines, such as diethyl or diisopropylamine, dicyclohexylamined, peperidine, triisopropylamine and higher homologues thereof.

BRIEF SUMMARY OF THE INVENTION

Briefly, the present invention comprises the use of unique combinations of vapor phase inhibitors in a chemically and physically stable foam carrier impregnated with one, two, three or more vapor phase inhibitors.

A reticulated foam is formed by a process of cell formation with subsequent rupture of the cell walls leaving only the interconnecting structural members defining the cells. In essence, this discovery creates the opportunity and advances the art and science toward the goal of the preparation, at will, of random, mechanically mixed corrosion inhibiting chemicals largely selected from groupings and classifications dependent upon their varying partial vapor pressures.

BRIEF DESCRIPTION OF THE DRAWING

FIG. 1 is a perspective view of a carrier for an applicable volatile corrosion inhibitor system;

FIG. 2 is a perspective view of a carrier packaged in an air-tight enclosure;

FIG. 3 is a carrier in a coil form;

FIG. 4 is an enlarged view of the internal structure of the carrier; and

DESCRIPTION OF THE PREFERRED EMBODIMENT

Figure 5:
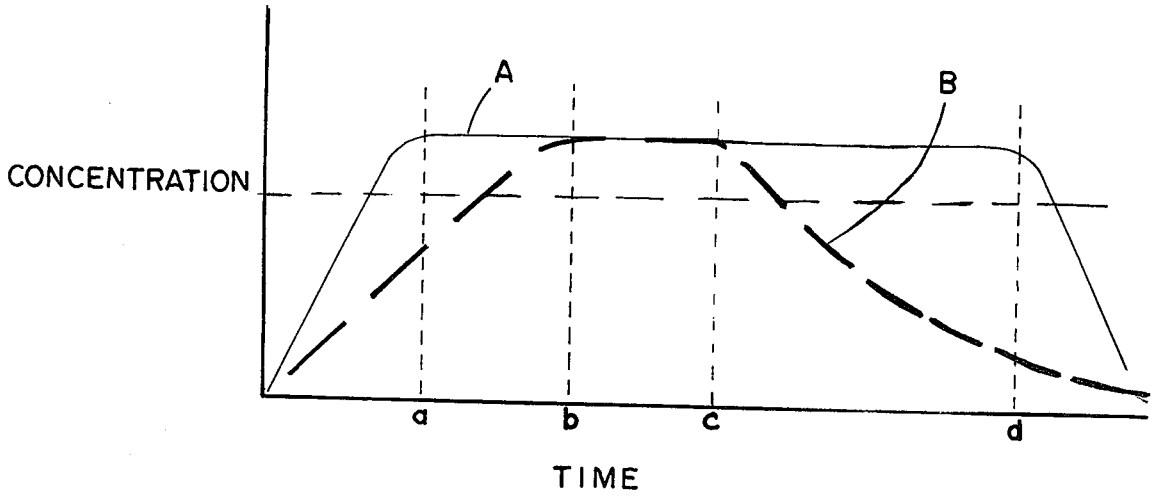
FIG. 5 show a graph of corrosion inhibitor as function of time.

FIG. 1 shows a volatile corrosion inhibitor carrier designated by reference numeral 10 comprising an open cell isocyanate-derived polymer known as polyurethane. The height of carrier 10 is designated by H. The width by W and the length by L. Located on one side of carrier 10 is an adhesive layer 12 for fastening the carrier to a surface. Typically, carrier 10 fastens to a wall or other surface, normally, on or near the top in a closed area to provide a continuous source of the volatile corrosion inhibitor from the appropriately selected composition on the corrosion inhibiting systems suitable matched to the specific hostile corrosive problem. No external, mechanical or physical pumping action is advantageous, desireable, indicated or needed and should be avoided when used with the present invention, because the vapors of these volatile corrosion inhibiting devices are heavier than air and possess vapor densities very significantly greater than one.

FIG. 3 shows a corrosion inhibitor carrier 20 in a coil form having adhesive layer 22 located on one side. To illustrate how the coil may be used, a section 23 has been cut from the end of the roll. The purpose of having a coil is to allow one to cut the carrier to any desired size. This feature allows the user to match the carrier size and the volatile corrosion inhibitor load to the specific corrosion problem and to the container volume to be protected.

FIG. 4 shows the completely open cell arrangement of the isocyanate-derived polymer foam. Located throughout the foam is a network of interconnecting members 16 located around an open space 17. In the preferred embodiment, the combination of designed volatile corrosion inhibitor systems and isocyanate-derived open cell polymer foams provides superior storage capacity and an expansion of the effective diffusive surface area of and the large wall area of, the multicavity sites.

The complete open cell isocyanate-derived polmer foam is known in the art. To make a low density polymeric cellular foam structure, it is necessary to have an expansion of bubbles from gas or vapor within a polymer mass. As the bubbles expand they contact one another and deform the spherical shaped bubble into a polyhedral configuration. Generally, each sphere is surrounded by twelve other spheres so that the resultant cellular structure comprises strands and membranes of the polymer which defines the edges and faces of the cells. The cells generally have a dodecahedral shape with pentagonal sides. It should be understood that within any foam structure cells can be found of varying shapes, but as a general rule this type of structure exists throughout the foam. The cells are expanded to the point of intra-structural contact to form polyhedral cells. When sufficient gas pressure is reached, the cell wall ruptures to produce an open cell structure void of cell faces. Open cell structure without faces are called reticulated foams and is understood to mean the cells are connected with a skeleton network while the open cell foams are generally understood to mean that the cells are inter-communicating with large gaps therebetween and with the major portion of the cell faces having been altered or removed.

In general, the structure defined as shown in FIG. 4 is a reticulated foam in which polymer strands define the outline of the cells of the polymer. In a typical polymer, the cell opening 16 may be less than 1.5 mm in diameter.

It is the remarkable chemical and physical stability of the isocyanate-derived polymer structures, which have been discovered to be important for practical vapor phase corrosion application, as well as the extensively large carrier capabilities, which are extremely useful for volatile corrosion inhibitor system (s) of sufficient life span to render such systems practical, efficient and effective for reliable corrosion control delivery to critical sites. Such sites may be in highly inaccessible locations and in hostile or adverse environments.

It was discovered that the volatile corrosion inhibitor (s) can be transported and solvent dispersed through the open cell structure of the isocyanate-derived polymer foam by immersion and deaeration. After the corrosion inhibitor is dispersed through the structure, the liquid solvent system is selectively removed through controlled evaporation leaving volatile corrosion inhibitor (s) located at and within the cell sites throughout the large, comparatively rigid structure of this isocyanate-derived polymer foam. Maximum loading per cycle is achieved by using a near saturated solution of the applicable chemicals (s). After solvent removal via slow evaporation normally at room temperature in the presence of moving air and a slight negative pressure, the previously treated isocyanate-derived polymer foam may be impregnated a second, (or more) time with a like saturated solution of the same chemicals to substantially increase the loading (0.7–0.8 more by weight, based on the first load considered as 1). Drying follows each impregnation.

A range of chemicals may be deposited into the cavities of the isocyanate-derived polymer foam by utilizing sharp shifts in the polar nature of the solvent system. In this invention we deposited succeeding loads of chemicals in the order of their decreasing polarity, i.e., the most polar in the first impregnation and the least polar in the last impregnation. Thus, markedly different chemicals could be successively deposited in the isocyanate-derived polymer foam.

A completely loaded carrier can be covered on one side with a protected, peelable pressure sensitive adhesive for later attachment of the volatile corrosion inhibitor carrier system to a storage container wall.

Corrosive atmospheres quickly degrades many foams. However, the open cell isocyanate-derived polymer foam, either loaded or unloaded, can be put in hostile environments without fear of degradation of the foam carrier's basic structure. The deterioration of the foam carrier destroys its integrity and has been found to have an adverse effect on efficient dispensing of the volatile corrosion inhibitors.

The combination of the open cell isocyanate-derived polymers foams and the volatile corrosion inhibitors have been discovered to provide both a high storage of volatile corrosion inhibitor and a far more effective dispersion of the corrosion inhibitor than prior art cellulosic materials. It was discovered that the open cell reticulated structure provides more sites for the deposition and/or crystallization of the corrosion inhibitor and far greater surface area for the more efficient dispersion of the volatile corrosion inhibitors into the desired atmosphere than either the conventional closed cell or those foams which are often called open cell foams. To illustrate the combination of the isocyanate-derived polymer and the volatile corrosion inhibitor, references should be made to FIG. 5.

FIG. 5 illustrates the dramatic effect of the synergistic combination of the isocyanate reticulated derived polymer and the corrosion inhibitors selected from a group of high, intermediate and low vapor pressure inhibitors.

Note, the front portion of curve A up to point "a" denoted rapid increase in concentration to saturation level with the present invention. Curve B is typical of the slower concentration increase with conventional carriers or other open cell polymers having a single vapor pressure inhibitor or more than one vapor pressure inhibitors of substantially the same vapor pressure. It is believed the rapid increase in the concentration level is due to two factors. One, the openness of the carrier structure which permits rapid evolution and migration of the corrosion inhibitor from the carrier to the atmosphere. Two, the use of various corrosion inhibitors of substantially different vapor pressures. It has been discovered that the following three groups of vapor pressure inhibitors provide the type of rapid protection typified by curve A. Group I comprises the low vapor pressure inhibitors. These inhibitors are characterized by a vapor pressure of less than $10^{-4}$ mm Hg at ambient conditions and 20° C. Group II comprises the intermediate vapor pressure inhibitors. These inhibitors are characterized by a vapor pressure ranging from $10^{-3}$ mm Hg to $10^{-4}$ mm Hg at ambient conditions and 20° C. Group III comprises the high vapor which are characterized by vapor pressure above $10^{-3}$ mm Hg at ambient conditions and 20° C.

Note, the rear portion of the curves also denote a difference in the decrease in saturation concentration. For conventional carrier the rapid fall off below effective levels and then the long trailing off or dwindling away during the final exhaustion period occurs at and beyond point "c", whereas for the present invention the fall off occurs much later and much sharper at point "d". The mechanism which extends the useful life of carrier is not fully understood but is believed due to synergistic relationships between the carrier and the corrosion inhibitor. It is thought to be partially attributable to the reticulated open cell isocyanate-derived polymers which do not degrade. The lack of degradation of the carrier is believed to prevent physical clogging or blocking of the passages as well as to prevent physical coating and contamination of the residual inhibitor located in the carrier.

It has become well known that corrosion inhibitors function to protect objects located in hostile environments. Hostile environments are generally considered as environments that contain moisture, salts, corrosive agents, and/or the like. The hostile environment is in effect an environment that is harmful to articles such as metals or the like which are stored in the environment. The corrosion inhibitors are introduced into the environment to provide a protection to the article. In reality there is a second type of hostile environment which is just as critical, i.e., the hostility of the environment to the carrier rather than to the article to be protected. Heretofore, the carrier has been suggested as papers, natural rubbers, polyurethane or the like. While it is believed that a synergistic relationship between certain carriers and the corrosion inhibitor results in extended life, it is also believed the ability of the carrier to withstand environments hostile to the carrier is also critically important.

EXAMPLE 1

An isocyanate-derived polymer was impregnated with volatile corrosion inhibitor as well as a conventional closed cell foam. Because of the closed cell structure, the closed cell foam had to have the cavity (cavities) physically loaded with 0.25 grams of a powdered mixture of volatile corrosion inhibitor, antioxidant and fungistat by applying the mixture to the outside of the foam. The open cell isocyanate-derived polymer foam was impregnated with the volatile corrosion inhibitor dicyclohexylamine nitrite. The powdered inhibitor was dissolved in a solvent and then impregnated into the foam. After deaireating and impregnating the foam, the solvent was allowed to evaporate leaving the residual dicyclohexylamine nitrite thoroughly dispersed throughout the open cell isocyanate-derived polymer foam. It was found that the isocyanate-derived polymer foam absorbed 3 grams of volatile corrosion inhibitor or approximately 12 times as much as the prior art closed cell foam. The load could be increased an additional 70% by a second impregnation. The dispersion rate of inhibitor from the two foams was checked. The dispersion rate of the volatile corrosion inhibitor from the impregnated isocyanate-derived polymer foam was faster, more uniform, and of longer duration than the dispersion rate of the volatile corrosion inhibitor from the foam that was physically loaded with volatile corrosion inhibitor powder. It was discovered that the open celled isocyanate-derived polymer foam dramatically increased the total loading capacity and the dispensing efficiency via deairiation, solvent impregnation and controlled solvent removal.

To determine the effectiveness of the foam carriers in preventing corrosion of metals, a total of four test jars were prepared. In each test jar two metal specimens were hung (both made of mild steel). The metal specimens were degreased by washing in methanol and air dried for 20 minutes just prior to the experiment. Two pieces of impregnated isocyanate-derived foam with the volatile corrosion inhibitor dicyclohexylamine nitrite were cut to measure approximately 3"×1-1¼"×¼". The impregnated foam was applied to the lid of the test jar I and test jar II by using an adhesive, while the two remaining test jars III and IV were left unprotected in order to determine the difference in appearance of protected and unprotected metal specimens. Approximately 50 ml of tap water was introduced into each jar to create proper humidity conditions. To accelerate the corrosion experiment, the temperature was cycled from 120° F. to 70° F. (49° C. to 21° C.) each 12 hours which produced cyclic condensation and volatilization of the water. After 14 days (14 cycles) the metal specimens were removed from the test jars and inspected for corrosion. The following summarizes the results:

| | |
|---|---|
| JAR I | Protected<br>Metal specimen 1 - 100% surface clean of rust; metal bright and shiny. No changes detected compared to original appearance.<br>Metal specimen 2 - Same as Metal specimen 1. |
| JAR II | Protected<br>Same as JAR 1. |
| JAR III | Unprotected<br>Metal specimens 1 and 2 surface shows severe corrosion and formation of red rust over entire surface. |
| JAR IV | Unprotected<br>Same as JAR III. |

In general, it has been discovered that to maximize the effectiveness of the isocyanate-derived polymer, the optimal ratio between the thickness or the minimum dimension of the foam carrier and the width of the carrier is about 1 to 12.

To obtain adequate corrosion protection over an extended period and to utilize the effective area of the open cell polymer, one should have a minimum of about 0.05 grams of vapor phase inhibitor per cubic centimeter of open celled isocyanate-derived polymer.

To protect a given volume of one (1) cubic foot, one should have a foam carrier containing a minimum of 1 gram of vapor phase corrosion inhibitor.

To illustrate the useful combination of selected polyurethane foam carriers and vapor phase inhibitors, numerous combinations of one, two, three or more inhibitors were impregnated into a foam carrier. Sometimes a second impregnation was used to increase the inhibitor load or to implant another chemical with markedly different solubility or different vapor pressure. It was discovered that the foam carrier and the vapor phase inhibitors could provide corrosion protection to an article over an extended period of time if at least two vapor phase corrosion inhibitors of selectively different vapor pressures were impregnated in the foam carrier.

The vapor phase inhibitors can be classified into three groups based on their vapor pressure at ambient conditions and 20° C. Group I comprises the low vapor pressure inhibitors. These inhibitors are characterized by a vapor pressure of less than $10^{-4}$ mm Hg at ambient conditions and 20° C. Group II comprises the intermediate vapor pressure inhibitors. These inhibitors are characterized by a vapor pressure ranging from $10^{-3}$ mm Hg to $10^{-4}$ mm Hg at ambient conditions and 20° C. Group III comprises the high vapor pressure inhibitors which are characterized by vapor pressures above $10^{-3}$ mm of Hg at ambient conditions and 20° C. The following table shows examples of typical vapor phase inhibitors separated into groups which are characterized and separated only by the vapor pressure of the inhibitor:

TABLE I

| | |
|---|---|
| I. | Low Vapor Pressure Inhibitors (Less than $10^{-4}$ mm Hg at 20° C.) |
| | Cyclohexylamine Chromate |
| | Cyclohexylamine M-Mononitro-Benzoate |
| | Dicyclohexylamine Chromate |
| | Dicyclohexylamine Nitrite |
| II. | Intermediate Vapor Pressure Inhibitors ($10^{-3}$ mm Hg to $10^{-4}$ mm Hg at 20° C.) |
| | Cyclohexylamine Benzoate |
| | Diethanolamine Benzoate |
| | Benzotriazole |
| III. | High Vapor Pressure Inhibitors (More than $10^{-3}$ mm Hg at 20° C.) |
| | Monoethanolamine Benzoate |
| | Tolyltriazole |

Since some inhibitors may be more effective on certain metals, one can tailor-make a corrosion inhibiting device for specific applications. For example, if zinc metal is to be protected, one could select monoethanolamine benzoate from Group III since it is an effective corrosion inhibitor for zinc metals. It will be readily apparent that when the corrosion inhibitors are selected by vapor pressure, one can use any inhibitor, or combination thereof, that has the desired and/or required vapor pressure(s) in the construction of the device. When the foam carrier is impregnated with two or more different vapor phase corrosion inhibitors, one can construct corrosion inhibiting devices with synergistic potentiation and/or sustained and prolonged effective life.

The rule followed was that the foam carrier should have at least two vapor phase inhibitors from different groups. In addition, if only two vapor phase inhibitors were used, there should be a minimum of at least 5% by weight of the minor vapor pressure inhibitor. The following examples illustrate the combinations that were impregnated in the foam carrier in accordance with the method of Example 1. Each example also includes the useful range of inhibitors with the given combination of vapor phase inhibitors.

EXAMPLE 2

| Group | Inhibitor | % by Weight | Useful Rate Minimum | Useful Rate Maximum % |
|---|---|---|---|---|
| I | Cyclohexylamine Chromate | 10 | 5 | 40 |
| II | Cyclohexylamine Benzoate | 90 | 60 | 95 |
| EXAMPLE 3 | | | | |
| I | Dicyclohexylamine Nitrite | 20 | 5 | 25 |
| II | Benzotriazole | 20 | 5 | 25 |
| III | Cyclohexylamine Benzoate | 30 | 20 | 50 |
| IV | Monoethanolamine Benzoate | 30 | 20 | 50 |
| EXAMPLE 4 | | | | |
| I | Dicyclohexylamine Nitrite | 25 | 20 | 60 |
| II | Cyclohexylamine Benzoate | 75 | 40 | 80 |
| EXAMPLE 5 | | | | |
| II | Cyclohexylamine Benzoate | 90 | 50 | 95 |
| III | Monoethanolamine Benzoate | 10 | 5 | 50 |
| EXAMPLE 6 | | | | |
| I | Cyclohexylamine M-Mononitro Benzoate | 50 | 30 | 60 |
| II | Diethanolamine Benzoate | 25 | 10 | 90 |
| III | Tolyltriazole | 25 | 10 | 40 |
| EXAMPLE 7 | | | | |
| I | Cyclohexylamine Chromate | 30 | 5 | 90 |
| I | Dicyclohexylamine Nitrite | 10 | 5 | 40 |
| II | Cyclohexylamine Benzoate | 30 | 20 | 60 |
| III | Monoethanolamine Benzoate | 30 | 20 | 60 |
| EXAMPLE 8 | | | | |
| II | Benzotriazole | 20 | 5 | 40 |
| II | Cyclohexylamine Benzoate | 40 | 25 | 50 |
| III | Monoethanolamine Benzoate | 40 | 25 | 50 |

While more than two vapor phase inhibitors were used in a foam carrier, it should be noted that for Examples 2–8 there was never less than one vapor phase inhibitor from at least two of the three groups. In addition, if a vapor phase corrosion inhibitor was selected only from the combinations of Group I and III, it was preferred to have a major amount of the Group I inhibitor and a minor amount of the Group III inhibitor.

Although conventional foams are useable as carriers for the vapor phase inhibitors, they generally lack the stability of the isocyanate-derived polymer foams and the greater holding capacity of the reticulated foams, thus, the preferred carriers are the isocyanate-derived polymers or the reticulated foams.

The foam carrier with the combination of vapor phase inhibitors as indicated by the examples, provide a convenient to use corrosion inhibiting device that provides long life. In addition, the use of the protective package around the foam carrier vapor phase inhibitor provides long shelf life. Therefore, the present invention provides the user with a convenient and practical corrosion inhibiting product that provides both long shelf life and corrosion protection over an extended period of time.

FIG. 5 also reveals the effective inhibitor ranges with the region above the horizontal dashed line indicating the effective time range. Note, the increased life of inhibitor A over conventional inhibitor B.

We claim:

1. An adhesive backed carrier and corrosion inhibitor in strip form for placing into an atmosphere wherein an article is located which requires corrosion protection from the atmosphere surrounding the article wherein the carrier and corrosion inhibitor are operable for quickly inhibiting atmospheric corrosion of the article from the atmosphere through volatilization and air diffusion of volatile vapor phase corrosion inhibitors located in the carrier; said carrier comprising an isocyanate-derived polymer carrier having an interconnecting skeleton network defining a plurality of passages therein, said carrier having a minimum of 90% open area, said carrier having dispersed in the passages of said carrier vapor phase corrosion inhibitors in crystal form, said vapor phase corrosion inhibitors dispersed in said carrier comprising vapor phase corrosion inhibitors capable of vaporizing under ambient conditions of the atmosphere surrounding the article to be protected, said vapor phase corrosion inhibitors comprised of at least a first vapor phase corrosion inhibitor and a second vapor phase corrosion inhibitor, said first vapor phase corrosion inhibitor comprising a vapor phase corrosion inhibitor of a predetermined vapor pressure and said second vapor phase corrosion inhibitor comprising a vapor phase corrosion inhibitor of a vapor pressure different from the predetermined vapor pressure of said first vapor phase corrosion inhibitor so that when said first vapor phase corrosion inhibitor and said second vapor phase corrosion inhibitor are dispersed in said carrier said carrier contains vapor phase corrosion inhibitors of unequal vapor pressure dispersed throughout said carrier to thereby provide multiple sites for volatilization of said first vapor phase corrosion inhibitor and said second vapor phase corrosion inhibitor from said carrier into the atmosphere surrounding said carrier, said first vapor phase corrosion inhibitor and said second vapor phase corrosion inhibitor selected from a group of vapor phase corrosion inhibitors consisting of a first group of vapor phase corrosion inhibitors having a vapor pressure of less than $10^{-4}$ mm Hg at ambient conditions, said first group consisting of the following corrosion inhibitors: Cyclohexylamine Chromate, Cyclohexylamine M-Mononitro Benzoate, Dicyclohexylamine Chromate and Dicyclohexylamine Nitrite; a second group of vapor phase corrosion inhibitors having a vapor pressure ranging from $10^{-3}$ mm Hg to $10^{-4}$ mm Hg, at ambient conditions, said second group consisting of the following corrosion inhibitors: Cyclohexylamine Benzoate, Diethanolamine Benzoate, and Benzotriazole, and a third group of vapor phase corrosion inhibitors having vapor pressure above $10^{-3}$ mm Hg at ambient conditions, said third group consisting of the following corrosion inhibitors: Monoethanolamine Benzoate and Tolyltriazole, wherein the total vapor phase corrosion inhibitors located in said carrier includes a minimum of 5% by weight of vapor phase corrosion inhibitors selected from at least two of said first group, said second group or said third group, said vapor phase corrosion inhibitor in said carrier comprises a minimum density of vapor phase corrosion inhibitor of 0.05 grams per cubic centimeter, wherein if one vapor phase corrosion inhibitor is selected from said first group and one vapor phase corrosion inhibitor is selected from said third group, the major amount of vapor phase corrosion inhibitor being selected from said first group and the minor amount of vapor phase corrosion inhibitor being selected from said third group, said first vapor phase corrosion inhibitor, said second vapor phase corrosion inhibitor and said interconnecting network located in said carrier coacting with said passages in said carrier to quickly permit said first vapor phase corrosion inhibitor and said second vapor phase corrosion inhibitor to reach a saturation level in the atmosphere surrounding said carrier through volatilization and diffusion of said first vapor phase corrosion inhibitors and said second vapor phase corrosion inhibitor from sites in said carrier and through said passages in said carrier, said first vapor phase corrosion inhibitor and said second vapor phase corrosion inhibitor synergetically coacting with said carrier to produce an extended saturated level of corrosion inhibitor in an atmosphere surrounding said carrier, said carrier being enclosed in an enclosing means to prevent premature dispersion of said vapor phase corrosion inhibitor.

2. The invention of claim 1 wherein said carrier has a thickness and a width with the thickness about 1/12 times the width.

* * * * *